US005826299A

United States Patent [19]

Kim

[11] Patent Number: 5,826,299

[45] Date of Patent: Oct. 27, 1998

[54] BRUSH ASSEMBLY FOR A VACUUM CLEANER

[75] Inventor: Suk-Koo Kim, Seoul, Rep. of Korea

[73] Assignee: Daewoo Electronics Co., Ltd., Seoul, Rep. of Korea

[21] Appl. No.: 927,265

[22] Filed: Sep. 11, 1997

[30] Foreign Application Priority Data

Sep. 30, 1996 [KR] Rep. of Korea ..... 96-32299

[51] Int. Cl.[6] ..... A47L 9/00; A47L 9/02

[52] U.S. Cl. ..... 15/523; 15/398; 15/415.1

[58] Field of Search ..... 15/323, 398, 415.1, 15/338

[56] References Cited

U.S. PATENT DOCUMENTS 3,955,237 5/1976 Chateauneuf et al. ..... 15/323
4,554,700 11/1985 Lyman .
4,715,083 12/1987 Harris et al. ..... 15/323
5,046,218 9/1991 Cerri .
5,233,722 8/1993 McKnight et al. .
5,307,537 5/1994 Essex et al. ..... 15/323
5,379,483 1/1995 Pino ..... 15/323
5,713,103 2/1998 Keebler et al. ..... 15/323

*Primary Examiner*—Chris K. Moore
*Attorney, Agent, or Firm*—Cushman Darby & Cushman Intellectual Property Group of Pillsbury Madison & Sutro, LLP

[57] ABSTRACT

A brush assembly for a vacuum cleaner which can be simply manufactured by a molding working. The brush assembly has a body formed at an upper surface thereof with a recess, an air duct integrally formed with the body, and ribs for clamping the auxiliary brushes stored in the recess. The body is formed at an underside thereof with an air inlet. The air duct is communicated with the air inlet. Elements of the brush assembly are integrally manufactured by the molding working so that the cost of manufacturing the brush assembly is reduced.

10 Claims, 4 Drawing Sheets

BRUSH ASSEMBLY FOR A VACUUM CLEANER

BACKGROUND OF THE INVENTION

1. Field of the Invention

The present invention relates to a vacuum cleaner, and more particularly to a brush assembly for a vacuum cleaner which is provided with a recess for storing auxiliary brushes such as crevice tools or floor brushes and can be simply manufactured by a molding working.

2. Prior Art

A vacuum cleaner is an electrical appliance for removing dirt from carpets or floors by suction. Generally, the vacuum cleaner is classified into a canister mode vacuum cleaner and an upright mode vacuum cleaner.

In the canister mode vacuum cleaner, a cleaner body section and a brush section are separated from each other so that the brush section can separately move with respect to the cleaner body section while cleaning. Therefore, even when dust is collected on high places such as bookshelves, a user can easily remove dirt by simply moving the brush section onto the bookshelf without lifting the heavy cleaner body section.

In the upright mode vacuum cleaner, a cleaner body section is integrally formed with a brush section so that the brush section moves together with the cleaner body section while cleaning. Therefore, the upright mode vacuum cleaner does not occupy large space when stored or operated, and can be easily handled while cleaning.

FIG. 4 shows a conventional canister mode vacuum cleaner 500. As shown in FIG. 4, vacuum cleaner 500 comprises a brush assembly 510 for sucking dirt such as dust, an extension bar 520 in which one end is connected to brush assembly 510 and the other end is connected to a handle section 525, a body section 530 connected to handle section 525 by a flexible tube 535, and wheels 540 for moving body section 530.

Impurities sucked into brush assembly 510 are flowed into body section 530 through extension bar 520 and flexible tube 535 and collected in a trash bag (not shown) installed in body section 530.

FIG. 5 is an enlarged perspective view of brush assembly 510 shown in FIG. 4. As shown in FIG. 5, brush assembly 510 includes a frame 512 and a cover 514 coupled to the upper portion of frame 512. Extension bar 520 is connected to cover 514 by a neck 515 which is assembled with the upper portion of cover 514. At the underside of frame 512, there is provided a brush (not shown) for scratching dust adhering to the floor. In addition, an air inlet (not shown) for sucking air is formed at the underside of frame 512.

However, in conventional brush assembly 510, frame 512, cover 514 and neck 515 are separately manufactured so that not only is a process for assembling the above elements with each other required, but also the manufacturing cost thereof is increased.

In addition, when an excess external impact is applied to brush assembly 510, cover 514 may be separated from frame 512.

SUMMARY OF THE INVENTION

The present invention has been made to overcome the above described problems of the prior art, and accordingly it is an object of the present invention to provide a brush assembly for a vacuum cleaner which has a recess for storing auxiliary brushes and can be simply manufactured by a molding working.

In order to accomplish the above object the present invention provides a brush assembly comprising:

a rectangular body formed at an upper surface thereof with a recess for storing auxiliary brushes, the recess being formed in a longitudinal direction of the body;

an air duct for sucking air, the air duct including a horizontal portion disposed at a center of the body and a neck portion integrally formed with the horizontal portion, the air duct being integrally formed with the body, the horizontal portion dividing the recess into a first recess and a second recess, the neck portion being inclined upward with respect to the horizontal portion; and a means for clamping the auxiliary brushes stored in the recess.

According to a preferred embodiment of the present invention, the body is formed at edges of an underside thereof with an air inlet for sucking the air.

The horizontal portion has a dome shaped transverse section which is opened toward a floor so as to suck the air. The horizontal portion of the air duct is communicated with the air inlet of the body.

The means for clamping the auxiliary brushes includes a plurality of first ribs integrally formed with first longitudinal side wall of the recess and a plurality of second ribs integrally formed with second longitudinal side wall of the recess. The first longitudinal side wall is opposite to the second longitudinal side wall, and the first ribs are positioned in correspondence to the second ribs. The brush assembly is made of polypropylene.

In the brush assembly having the above construction, air including impurities is collected in a trash bag installed in the vacuum cleaner through both the air inlet and air duct.

When it is required to use auxiliary brushes, a user separates the brush assembly from an extension bar and assembles auxiliary brushes with the extension bar. Accordingly, the user can rapidly carry out the cleaning in the various places.

The brush assembly of the present invention can be simply manufactured by a molding working, so the cost of manufacturing the brush assembly is reduced.

In addition, since the brush assembly of the present invention has a rigid construction, the working life and durability thereof can be improved.

BRIEF DESCRIPTION OF THE DRAWINGS

The above object and other advantages of the present invention will become more apparent by describing in detail preferred embodiment thereof with reference to the attached drawings, in which.

DESCRIPTION OF THE PREFERRED EMBODIMENTS

Hereinafter, a preferred embodiment of the present invention will be described in detail with reference to the accompanying drawings. Elements having the same construction as the elements of the conventional vacuum cleaner will not be further described below.

Figure 1:
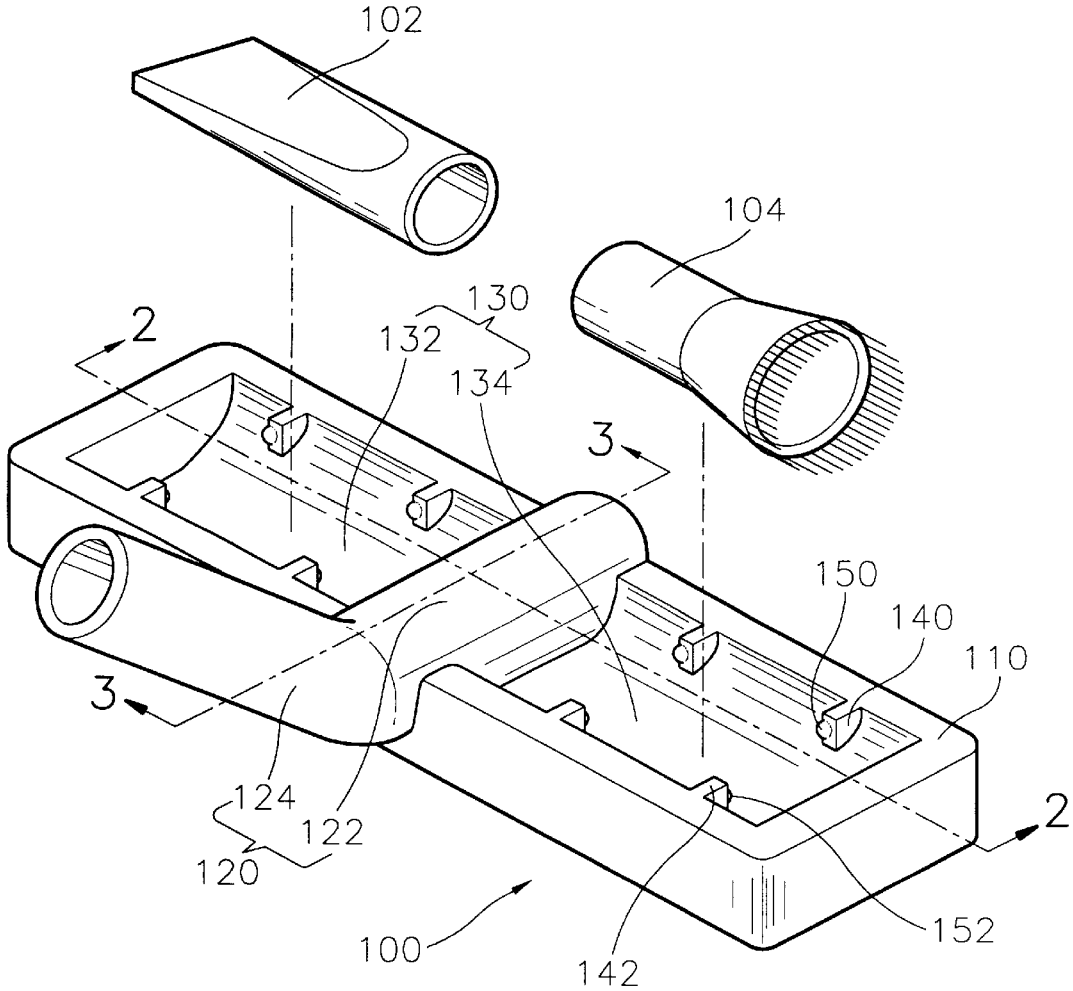
FIG. 1 is a perspective view of a brush assembly according to one embodiment of the of the present invention.

FIG. 1 shows a brush assembly 100 for a vacuum cleaner according to a preferred embodiment of the present invention.

Referring to FIG. 1, brush assembly 100 comprises a rectangular body 110 formed at an upper surface thereof with a recess 130 for storing auxiliary brushes such as a crevice tool 102 or a cylindrical brush 104. Recess 130 is formed in a longitudinal direction of body 110.

An air duct 120 for sucking air is integrally formed with body 110. Air duct 120 includes a horizontal portion 122 disposed at a center of body 110 and a neck portion 124 integrally formed with horizontal portion 122. Horizontal portion 122 divides recess 130 into a first recess 132 and a second recess 134. Neck portion 124 is inclined upward with respect to horizontal portion 122 so as to be assembled with an extension bar (not shown). According to a preferred embodiment of the present invention, a length of horizontal portion 122 is identical to a width of rectangular body 110.

Figure 2:
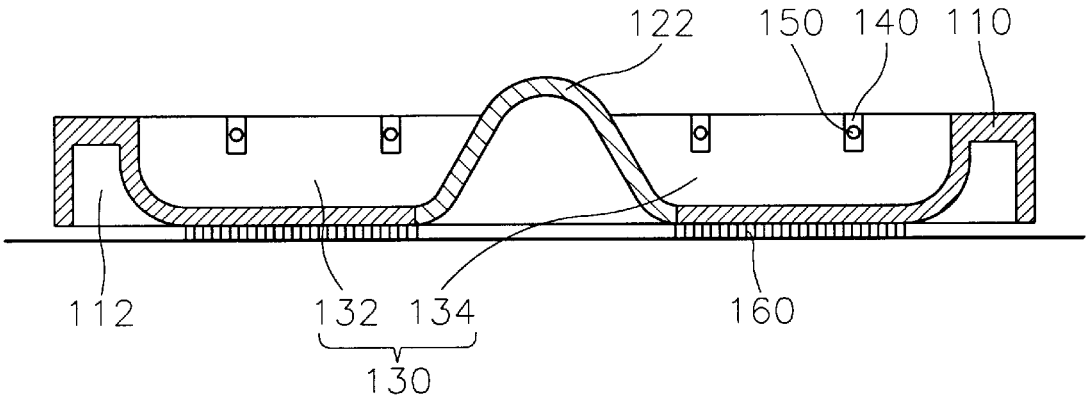
FIG. 2 is a sectional view taken along with line 2—2 of the brush assembly shown in FIG. 1.

FIG. 2 is a sectional view taken along with line B—B of brush assembly 100 shown in FIG. 1. Referring to FIG. 2, horizontal portion 122 of air duct 120 has a dome shaped transverse section which is opened toward a floor so as to suck air. Neck portion 124 has a hollow cylindrical shape. When suction force is generated by a blower assembly (not shown), air including impurities are flowed into a cleaner body through horizontal portion 122 and neck portion 124 and collected in a trash bag (not shown).

Figure 3:
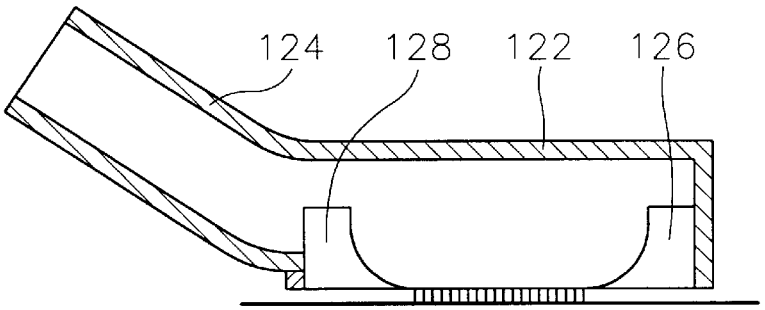
FIG. 3 is a sectional view taken along with line 3—3 of the brush assembly shown in FIG. 1.
Figure 4:
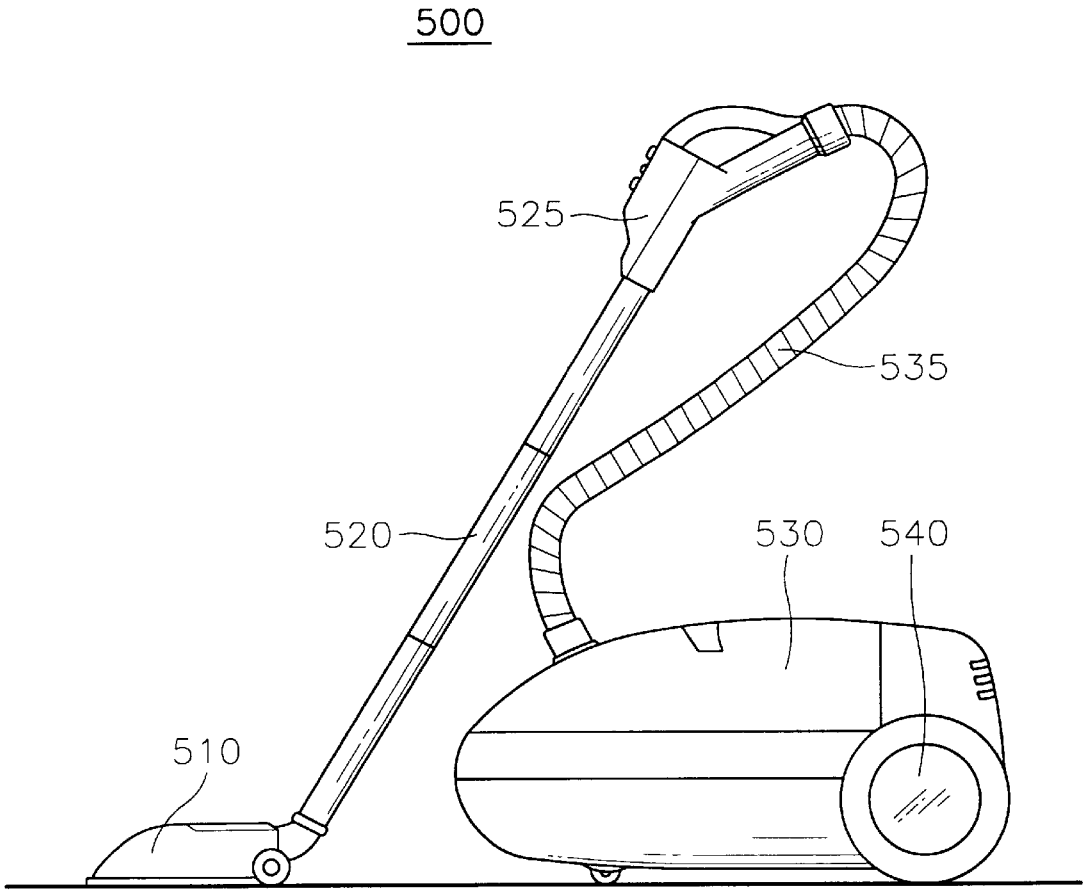
FIG. 4 (PRIOR ART)
FIG. 4 is a side view of a conventional vacuum cleaner.
Figure 5:
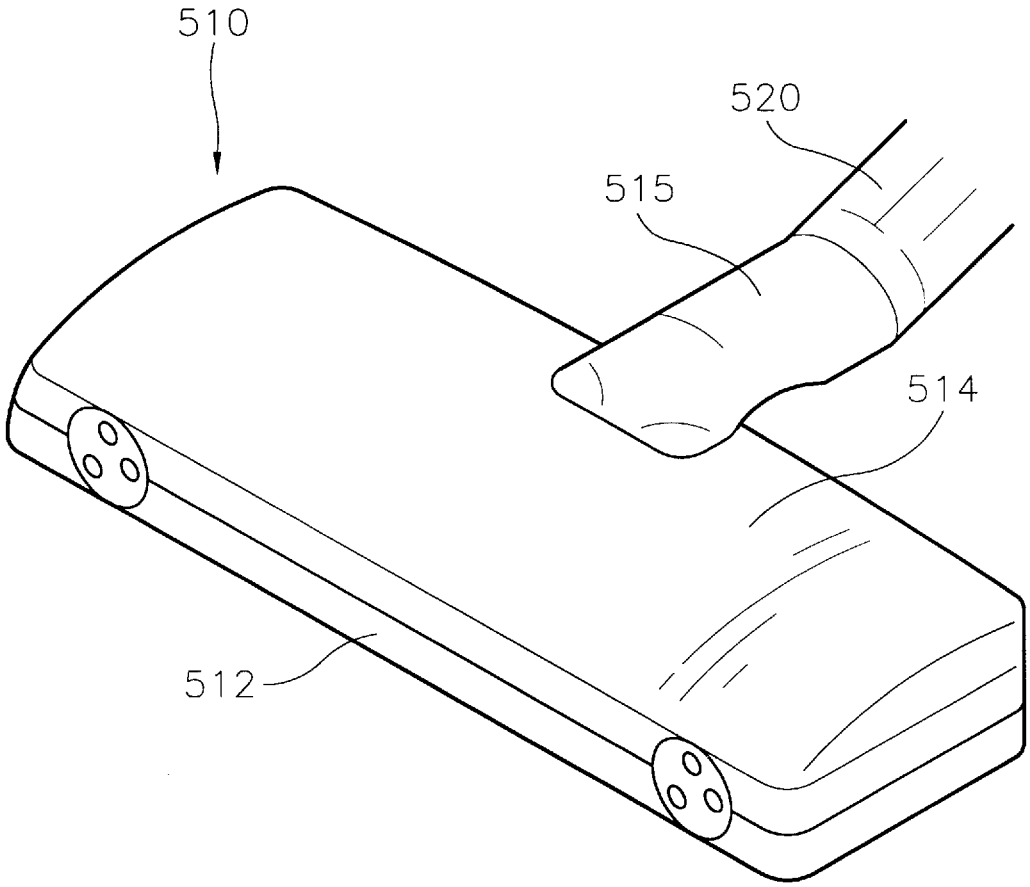
FIG. 5 (PRIOR ART)
FIG. 5 is an enlarged perspective view of a brush assembly of the conventional vacuum cleaner shown in FIG. 4.

In addition, body 110 is formed at edges of an underside thereof with an air inlet 112 for sucking the air. Air inlet 112 is defined by an inner wall of body 110 and by recess 130. As shown in FIG. 3, air inlet 112 is communicated with horizontal portion 122 of air duct 120 through a pair of first perforations 126 and a pair of second perforations 128 so that air including impurities are collected in the trash bag by passing through air inlet 112 and air duct 120. First perforations 126 are formed at a distal end of horizontal portion 122 in opposition to each other, and second perforations 128 are formed at a lead end of horizontal portion 122 in opposition to each other.

Referring again to FIG. 1, a plurality of first and second ribs 140 and 142 for clamping auxiliary brushes 102 and 104 stored in recess 130 are provided in recess 130. First ribs 140 are integrally formed with first longitudinal side wall of recess 130 and second ribs 142 are integrally formed with second longitudinal side wall of recess 130. The first longitudinal side wall is opposite to the second longitudinal side wall and first ribs 140 are positioned in correspondence to second ribs 142.

According to a preferred embodiment of the present invention, in order to securely support auxiliary brushes 102 and 104, each first rib 140 has a first protrusion 150 at a front surface thereof, and each second rib 142 has a second protrusion 152 at a front surface thereof. In this case, a distance between first protrusion 142 and second protrusion 152 should be smaller than an outer diameter of auxiliary brush 102 and 104. Preferably, brush assembly 100 is made of polypropylene.

Referring to FIG. 2, recess 130 has a flat bottom wall and is provided at an underside thereof with a brush 160 for scratching impurities adhering to the floor. Brush 160 is well known in the art and it is preferred to use a brush having a length of 2 mm to 5 mm.

In brush assembly 100 having the above construction, air including impurities is collected in the trash bag installed in the vacuum cleaner through both air inlet 112 and air duct 120 and air purified by a filter (not shown) is exhausted out of the vacuum cleaner.

On the other hand, when it is required to use auxiliary brushes 102 and 104, a user separates brush assembly 100 from the extension bar and assembles auxiliary brushes 102 and 104 with the extension bar. Accordingly, the user can rapidly carry out the cleaning in the various places.

As described above, the brush assembly of the present invention can be simply manufactured by a molding working, so the cost of manufacturing the brush assembly is reduced.

In addition, since the brush assembly of the present invention has a rigid construction, the working life and durability thereof can be improved. 14

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A brush assembly for a vacuum cleaner, the brush assembly comprising:

a rectangular body formed at an upper surface thereof with a recess for storing auxiliary brushes, the recess being formed in a longitudinal direction of the body;

an air duct for sucking air, the air duct including a horizontal portion disposed at a center of the body and a neck portion integrally formed with the horizontal portion, the air duct being integrally formed with the body, the horizontal portion dividing the recess into a first recess and a second recess, the neck portion being inclined upward with respect to the horizontal portion; and a means for clamping the auxiliary brushes stored in the recess.

2. The brush assembly as claimed in claim 1, wherein a length of the horizontal portion is identical to a width of the rectangular body.

3. The brush assembly as claimed in claim 1, wherein the body is formed at edges of an underside thereof with an air inlet for sucking the air, the air inlet being defined by an inner wall of the body and by the recess.

4. The brush assembly as claimed in claim 3, wherein the horizontal portion has a dome shaped transverse section which is opened toward a floor so as to suck the air, the neck portion having a hollow cylindrical shape.

5. The brush assembly as claimed in claim 4, wherein the horizontal portion of the air duct is communicated with the air inlet of the body.

6. The brush assembly as claimed in claim 1, wherein the recess has a flat bottom wall and is provided at an underside thereof with a brush for scratching impurities adhering to a floor.

7. The brush assembly as claimed in claim 1, wherein the means for clamping the auxiliary brushes includes a plurality of first ribs integrally formed with a first longitudinal side wall of the recess and a plurality of second ribs integrally formed with a second longitudinal side wall of the recess, the first longitudinal side wall being opposite to the second longitudinal side wall, the first ribs being positioned in correspondence to the second ribs.

8. The brush assembly as claimed in claim 7, wherein each first rib has a first protrusion at a first front surface thereof, and each second rib has a second protrusion at a second front surface thereof.

9. The brush assembly as claimed in claim 8, wherein a distance between the first protrusion and the second protrusion is smaller than an outer diameter of the auxiliary brush.

10. The brush assembly as claimed in claim 1, wherein the brush assembly is made of polypropylene.

* * * * *